US010957232B2

(12) United States Patent
Yamamoto et al.

(10) Patent No.: US 10,957,232 B2
(45) Date of Patent: Mar. 23, 2021

(54) CIRCUIT DEVICE, ELECTRO-OPTICAL DEVICE, ELECTRONIC APPARATUS, AND MOBILE BODY

(71) Applicant: SEIKO EPSON CORPORATION, Tokyo (JP)

(72) Inventors: Takekuni Yamamoto, Matsumoto (JP); Kazuto Kikuta, Chiba (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/697,316

(22) Filed: Nov. 27, 2019

(65) Prior Publication Data

US 2020/0168143 A1 May 28, 2020

(30) Foreign Application Priority Data

Nov. 28, 2018 (JP) ..... JP2018-221895

(51) Int. Cl.
*G09G 3/20* (2006.01)

(52) U.S. Cl.
CPC ..... *G09G 3/20* (2013.01); *G09G 2310/08* (2013.01); *G09G 2330/12* (2013.01); *G09G 2380/10* (2013.01)

(58) Field of Classification Search
None
See application file for complete search history.

(56) References Cited

U.S. PATENT DOCUMENTS

2002/0075255 A1* 6/2002 Baek ..... G09G 5/006 345/212
2005/0237429 A1 10/2005 Grundmeyer et al.
2010/0302220 A1 12/2010 Baek et al.
2015/0033101 A1 1/2015 Chebruch et al.

FOREIGN PATENT DOCUMENTS

JP 2002-202768 A 7/2002
JP 2010-026294 A 2/2010
JP 2016-225685 A 12/2016

* cited by examiner

*Primary Examiner* — Christopher J Kohlman
(74) *Attorney, Agent, or Firm* — Oliff PLC

(57) ABSTRACT

A circuit device (100) includes: a pixel clock judgment circuit (110) that outputs a pixel clock judgment signal ERPX that is activated if an edge of a pixel clock signal PXCK has not been detected in a detection period that is set by a reference clock signal RFCK; a signal judgment circuit (120) that judges whether or not a display control signal DCS is normal based on the reference clock signal RFCK, and outputs a signal judgment signal EPDC that is activated if the display control signal DCS is anomalous; and a mask circuit (130) that masks the display control signal DCS when at least one of the pixel clock judgment signal ERPX and the signal judgment signal EPDC is activated.

12 Claims, 8 Drawing Sheets

CIRCUIT DEVICE, ELECTRO-OPTICAL DEVICE, ELECTRONIC APPARATUS, AND MOBILE BODY

The present application is based on, and claims priority from JP Application Serial Number 2018-221895, filed Nov. 28, 2018, the disclosure of which is hereby incorporated by reference herein in its entirety.

BACKGROUND

1. Technical Field

The present disclosure relates to a circuit device, an electro-optical device, an electronic apparatus, a mobile body, and the like.

2. Related Art

When controlling display of a display device, a processing device such as a CPU transmits image data and a display control signal to a display controller, and the display controller generates a display control signal for a display driver along with performing image processing. Also, a display driver drives an electro-optical panel based on image data subjected to image processing and the display control signal for the display driver.

When an anomalous display control signal is input to the display device, the electro-optical panel cannot be appropriately driven, and therefore there is a risk that anomalous display will occur, the electro-optical panel will fail, or the like. For example, in JP-A-2002-202768, a method is disclosed in which whether or not an input signal is normal is judged by detecting whether or not the input signal to be input to a liquid crystal panel is present, and the magnitude of the input signal, and the judgment result is supplied to a control circuit.

In the above-described known technology, whether or not a pixel clock signal is anomalous is not judged. If the pixel clock signal is anomalous, it is possible that an electro-optical panel is not appropriately driven, and therefore the reliability of judging anomaly is low if judgment is performed with respect to only the input signal. Also, even if a circuit for detecting an anomalous pixel clock signal is further added, there remains a problem in that the circuit scale and complexity increase, which needs to be suppressed.

SUMMARY

One aspect of the disclosure relates to a circuit device including: a pixel clock judgment circuit that includes an edge detection circuit that detects an edge of a pixel clock signal, and is configured to output a pixel clock judgment signal that is activated if the edge of the pixel clock signal has not been detected by the edge detection circuit in a detection period that is set by a reference clock signal; a signal judgment circuit that is configured to judge whether or not a display control signal of an electro-optical panel is normal based on the reference clock signal, and output a signal judgment signal that is activated if the display control signal is anomalous; and a mask circuit configured to mask the display control signal when at least one of the pixel clock judgment signal and the signal judgment signal is activated.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Hereinafter, a preferable embodiment of the invention will be described in detail. Note that the embodiment described below is not intended to unduly limit the content of the invention described in the scope of the claims, and not all configurations described in this embodiment are necessarily essential as solving means of the invention.

1. Circuit Device

Figure 1:
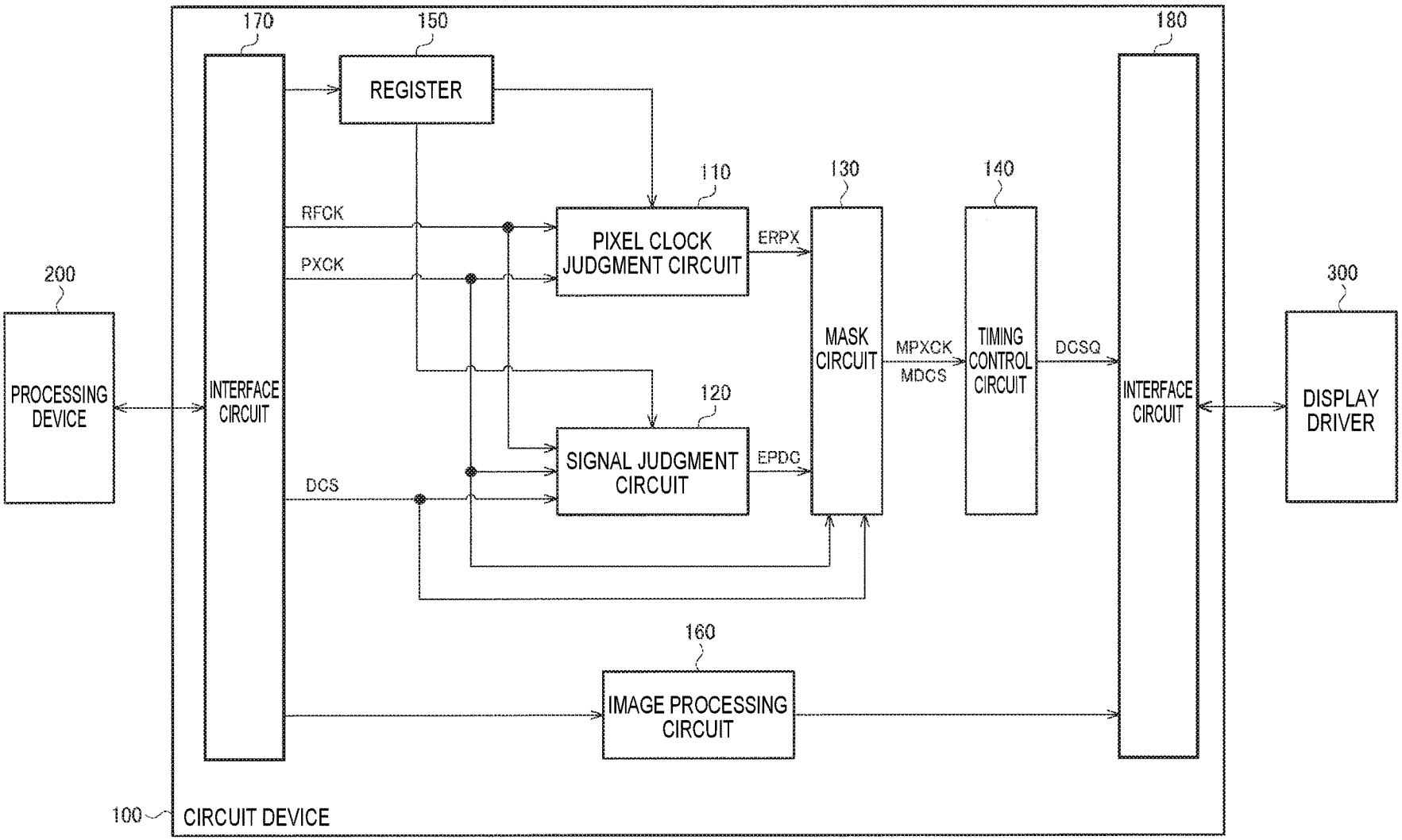
FIG. 1 is an exemplary configuration of a circuit device.

FIG. 1 is an exemplary configuration of a circuit device 100. The circuit device 100 is a display controller that outputs image data and a display control signal to a display driver 300. The circuit device 100 and the display driver 300 are separate integrated circuit devices. Note that the circuit device 100 may be configured to be one integrated circuit device in which the display controller and the display driver are integrated.

The circuit device 100 includes a pixel clock judgment circuit 110, a signal judgment circuit 120, and a mask circuit 130. Also, the circuit device 100 includes a timing control circuit 140, a register 150, an image processing circuit 160, and interface circuits 170 and 180.

The interface circuit 170 performs communication between a processing device 200 and the circuit device 100. Specifically, the interface circuit 170 receives a reference clock signal RFCK, image data, and a timing control signal from the processing device 200. An example of the reference clock signal RFCK is a system clock in an electronic apparatus including the processing device 200, or the like, but the reference clock signal RFCK need only be a clock signal that is different from a pixel clock signal PXCK. The timing control signal includes the pixel clock signal PXCK corresponding to the drive rate of pixels and a display control signal DCS that is used for display control of scan lines, frames, and the like. The display control signal DCS may include a horizontal synchronizing signal, a vertical synchronizing signal, and a data enable signal. Alternatively, the display control signal DCS may include one or two signals of the horizontal synchronizing signal, the vertical synchronizing signal, and the data enable signal. The interface circuit 170 receives setting information for setting operations of the circuit device 100, and stores the setting information in the register 150. Specifically, the setting information is information for setting operations of the pixel clock judgment circuit 110 and the signal judgment circuit 120.

An LVDS (Low Voltage Differential Signal) system, an RGB parallel system, a display port standard transmission system, or the like can be adopted as the communication system for the image data and the timing control signal.

Also, an I2C (Inter Integrated Circuit) system, an SPI (Serial Peripheral Interface) system, or the like can be adopted as the communication system for anomalous display line detection information and the like. The interface circuit 180 can include an input/output buffer circuit and a control circuit for realizing these communication systems.

The image processing circuit 160 performs image processing such as tone conversion processing on image data received from the processing device 200 via the interface circuit 170. The image processing circuit 160 outputs the image data subjected to the processing to the display driver 300 via the interface circuit 180.

The pixel clock judgment circuit 110 judges whether or not the pixel clock signal PXCK is normal based on the reference clock signal RFCK, and outputs the judgment result as a pixel clock judgment signal ERPX. The pixel clock judgment circuit 110, upon judging that the pixel clock signal PXCK is anomalous, activates the pixel clock judgment signal ERPX. Specifically, if an edge of the pixel clock signal PXCK has not been detected in a detection period set by the reference clock signal RFCK, the pixel clock judgment circuit 110 activates the pixel clock judgment signal ERPX. On the other hand, if at least one edge of the pixel clock signal PXCK has been detected in the detection period, the pixel clock judgment circuit 110 keeps the pixel clock judgment signal ERPX in a deactivated state.

The signal judgment circuit 120 judges whether or not the display control signal DCS received by the interface circuit 170 is normal based on the pixel clock signal PXCK, and outputs the judgment result as a signal judgment signal EPDC. The signal judgment circuit 120, upon judging that the display control signal DCS is anomalous, activates the signal judgment signal EPDC. On the other hand, the signal judgment circuit 120, upon judging that the display control signal DCS is normal, keeps the signal judgment signal EPDC in a deactivated state.

The mask circuit 130 judges whether or not the display control signal DCS is to be masked based on the pixel clock judgment signal ERPX and the signal judgment signal EPDC. Specifically, if at least one of the pixel clock judgment signal ERPX and the signal judgment signal EPDC is in an active state, the mask circuit 130 masks the display control signal DCS and the pixel clock signal PXCK. For example, the mask circuit 130 outputs the display control signal MDCS and the pixel clock signal MPXCK that are fixed at a low level or a high level. On the other hand, if both of the pixel clock judgment signal ERPX and the signal judgment signal EPDC are in a deactivated state, the mask circuit 130 outputs the display control signal DCS as a display control signal MDCS, and outputs the pixel clock signal PXCK as a pixel clock signal MPXCK.

The timing control circuit 140 outputs a display control signal DCSQ for the display driver based on the pixel clock signal MPXCK and the display control signal MDCS that are output from the mask circuit 130. The display control signal DCSQ for the display driver is a display control signal used for timing control in the display driver 300. The timing control circuit 140 converts the format of the pixel clock signal MPXCK and the display control signal MDCS to a format of the display control signal in an image interface system of the interface circuit 180. For example, in the LVDS system, the pixel clock signal, the vertical synchronizing signal, and the horizontal synchronizing signal are transmitted from the interface circuit 180 to the display driver 300. Alternatively, in a mini LVDS system, the horizontal synchronizing signal is embedded into image data, and the image data into which the horizontal synchronizing signal is embedded is transmitted from the interface circuit 180 to the display driver 300.

The pixel clock judgment circuit 110, the signal judgment circuit 120, the mask circuit 130, the timing control circuit 140, and the image processing circuit 160 are logic circuits. These circuits may be configured as separate logic circuits. Alternatively, these circuits may be integrally formed as a gate array circuit or a standard cell array circuit. The gate array circuit refers to an array circuit in which logic cells are automatically placed and signal lines are automatically routed. Also, in the standard cell array circuit, the logic cells are standardized cells. The standard cell array circuit refers to an array circuit in which signal lines are automatically routed to the logic cell array.

The interface circuit 180 performs communication between the circuit device 100 and the display driver 300. Specifically, the interface circuit 180 transmits, to the display driver 300, image data output from the image processing circuit 160 and the display control signal DCSQ for the display driver that is output from the timing control circuit 140.

An LVDS (Low Voltage Differential Signal) system, an RGB parallel system, a display port standard transmission system or the like can be adopted as the communication system of the image data and the timing control signal in the interface circuits 170 and 180. Also, an I2C (Inter Integrated Circuit) system, an SPI (Serial Peripheral Interface) system, or the like can be adopted as the communication system of the register setting information. The interface circuits 170 and 180 can each include an input/output buffer circuit and a control circuit for realizing these communication systems. Note that the communication system of the interface circuit 170 may be different from that of the interface circuit 180.

According to the embodiment described above, the pixel clock judgment circuit 110 outputs the pixel clock judgment signal ERPX. If an edge of the pixel clock signal PXCK has not been detected in a detection period set by the reference clock signal RFCK, the pixel clock judgment circuit 110 activates the pixel clock judgment signal ERPX.

In the present embodiment, whether the pixel clock signal PXCK is normal or not is judged, and therefore the reliability of judging anomaly can be improved compared with a case where judgment as to whether or not the signal is normal is performed only on the display control signal DCS. Also whether the pixel clock signal PXCK is normal or not is judged by detecting an edge thereof, and as a result, the increase in circuit scale and circuit becoming complex can be suppressed. For example, the edge detection can be realized by a simple circuit using several logic elements as in an edge detection circuit 111, which will be described later in FIG. 2.

A method of judging whether or not the pixel clock signal PXCK is normal by counting the number of clocks of the pixel clock signal PXCK in a detection period using a counter, and judging whether or not the count value has reached a predetermined value is conceivable as a method of judging the pixel clock signal PXCK, for example. However, a counter that counts the number of clocks of the pixel clock signal PXCK and a comparison circuit that compares the count value with a predetermined value are needed, and as a result the circuit scale increases and the degree of complexity of the circuit increases. In the present embodiment, as a result of using edge detection, the increase in circuit scale and circuit becoming complex can be suppressed.

2. Pixel Clock Judgment Circuit

Figure 2:
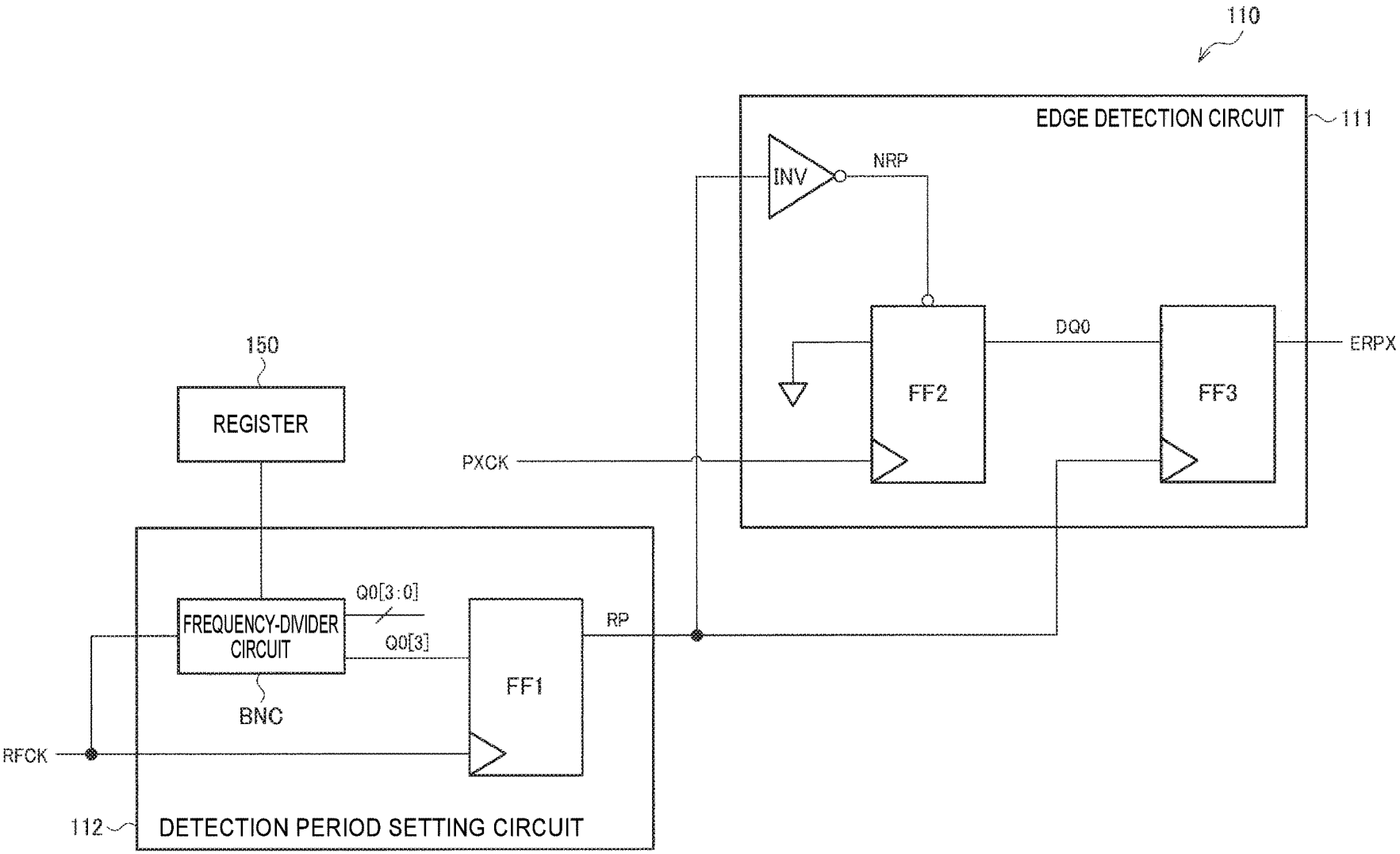
FIG. 2 is a detailed exemplary configuration of a pixel clock judgment circuit.

FIG. 2 is a detailed exemplary configuration of the pixel clock judgment circuit 110. The pixel clock judgment circuit 110 includes the edge detection circuit 111 and a detection period setting circuit 112.

The detection period setting circuit 112 sets a detection period based on the reference clock signal RFCK. The detection period is a period in which the edge detection circuit 111 detects an edge. Setting information for setting the length of the detection period is input from the register 150 to the detection period setting circuit 112, and the detection period setting circuit 112 sets the detection period based on the setting information. Specifically, the detection period setting circuit 112 includes a frequency-divider circuit BNC and a latch circuit FF1, which is a first latch circuit.

The frequency-divider circuit BNC frequency-divides the reference clock signal RFCK. Specifically, the frequency-divider circuit BNC is a counter that counts the number of clocks of the reference clock signal RFCK, and outputs a count value Q0[3:0]. The frequency-divider circuit BNC outputs Q[3], which is a most significant bit of the count value Q0[3:0], as a frequency-division clock signal. The setting information for setting the length of the detection period is information regarding the division ratio of the frequency-divider circuit. That is, the frequency-divider circuit BNC outputs the frequency-division clock signal Q[3] by frequency-dividing the reference clock signal RFCK at the division ratio designated by the information regarding the division ratio.

The latch circuit FF1 latches the frequency-division clock signal Q[3] based on the reference clock signal RFCK, and outputs the latched frequency-division clock signal Q[3] as a detection period setting signal RP.

The edge detection circuit 111 detects an edge of the pixel clock signal PXCK in the detection period. The detection period is judged by the detection period setting signal RP. Specifically, the edge detection circuit 111 includes a logical inversion circuit INV, a latch circuit FF2, which is a second latch circuit, and a latch circuit FF3, which is a third latch circuit.

The logical inversion circuit INV inverts the logic level of the detection period setting signal RP, and outputs the inverted detection period setting signal RP as a signal NRP. When the signal NRP is at a low level, the latch circuit FF2 is in a reset state. The reset state refers to a state in which the circuit is not operating. When the signal NRP is at a high level, the latch circuit FF2 operates based on an edge of the pixel clock signal PXCK. The latch circuit FF3 latches a signal DQ0 output from the latch circuit FF2 based on the detection period setting signal RP, and outputs the latched signal DQ0 as a pixel clock judgment signal ERPX.

The operations of the pixel clock judgment circuit 110 will be described using FIGS. 3 and 4. Here, a case where the division ratio of the frequency-divider circuit BNC is 1/16 will be described as an example.

Figure 3:
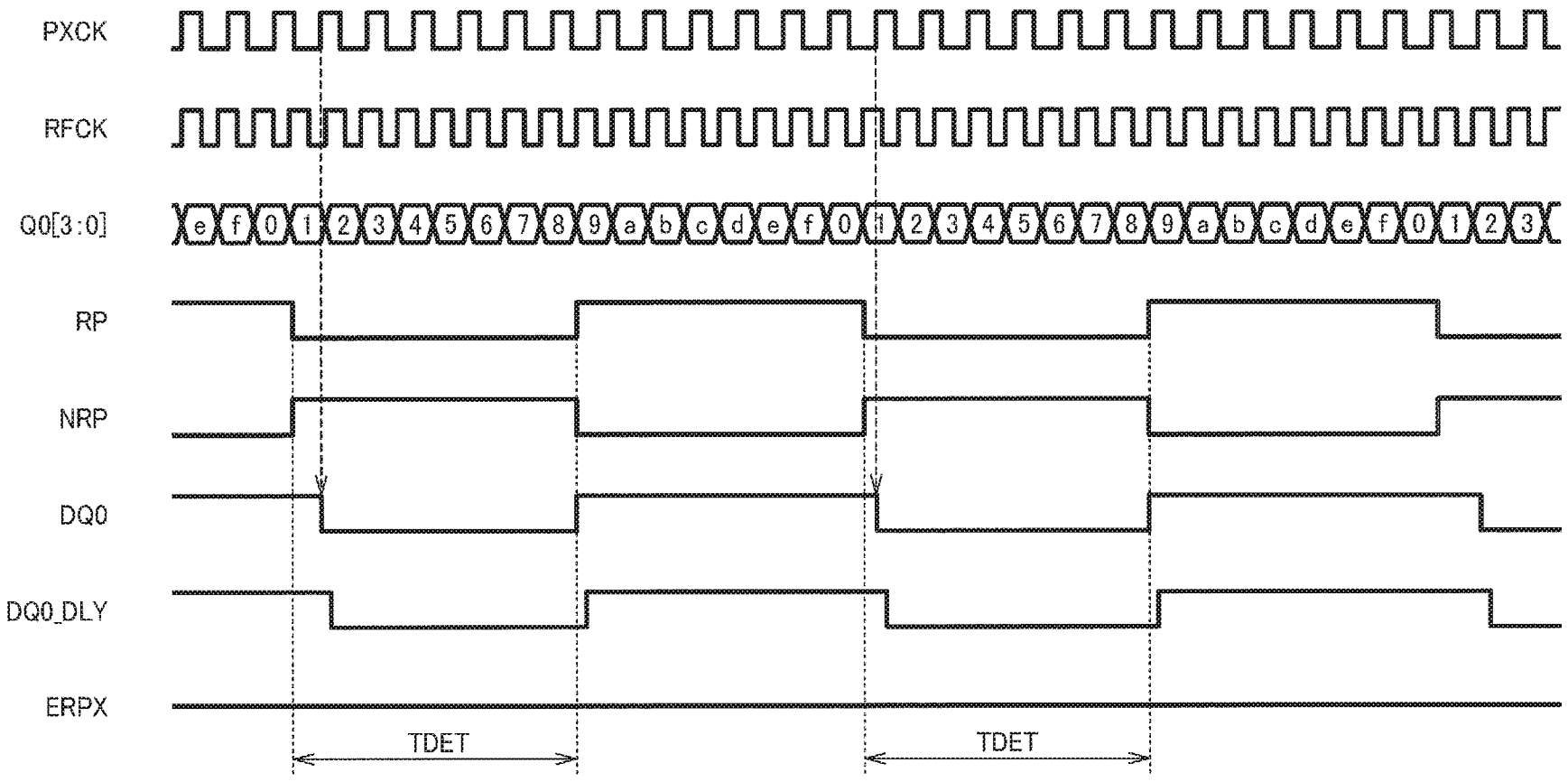
FIG. 3 is a diagram illustrating operations of the pixel clock judgment circuit.

FIG. 3 is a timing chart when the pixel clock signal PXCK is normal. The frequency-divider circuit BNC increments the count value Q0[3:0] at the rising edge of the reference clock signal RFCK. In FIG. 3, the count value Q0[3:0] is denoted by a hexadecimal number. The latch circuit FF1 outputs the detection period setting signal RP by latching the Q0[3] at a rising edge of the reference clock signal RFCK. The logical inversion circuit INV outputs the signal NRP by inverting the logic level of the detection period setting signal RP.

When the detection period setting signal RP is at a high level, the signal NRP is at a low level. Here, the latch circuit FF2 is at a reset state, and output a signal DQ0 at a high level. When the level of the detection period setting signal RP changes from a high level to a low level, the level of the signal NRP changes from a low level to a high level. Here, the reset state of the latch circuit FF2 is canceled, and the latch circuit FF2 enters an operating state. That is, the period in which the detection period setting signal RP is at a low level is a detection period TDET.

When a rising edge of the pixel clock signal PXCK is input in the detection period TDET, the latch circuit FF2 latches a low level. With this, the level of the signal DQ0 changes from a high level to a low level. A signal DQ0_DLY is a signal that the signal DQ0 is delayed due to a parasitic capacitance and the like of a signal line. Alternatively, the edge detection circuit 111 includes a delay circuit, which is not illustrated, and outputs the signal DQ0_DLY by the delay circuit delaying the signal DQ0.

The latch circuit FF3 latches the signal DQ0_DLY at a rising edge of the detection period setting signal RP. When an edge of the pixel clock signal PXCK has been detected, the signal DQ0_DLY is at a low level, and therefore the pixel clock judgment signal ERPX is at a low level. When the detection period TDET has ended, the latch circuit FF2 enters a reset state, and as a result, the level of the signal DQ0 changes from a low level to a high level. Also, in a period from the end of one detection period TDET until the next detection period TDET, the edge detection is not performed, and therefore the pixel clock judgment signal ERPX is kept at a low level. In this way, when the pixel clock signal PXCK is normal, the pixel clock judgment signal ERPX is kept at a low level. Note that, in this example, the low level of the pixel clock signal PXCK corresponds to a deactivated state, and the high level of the pixel clock signal PXCK corresponds to an activated state.

Figure 4:
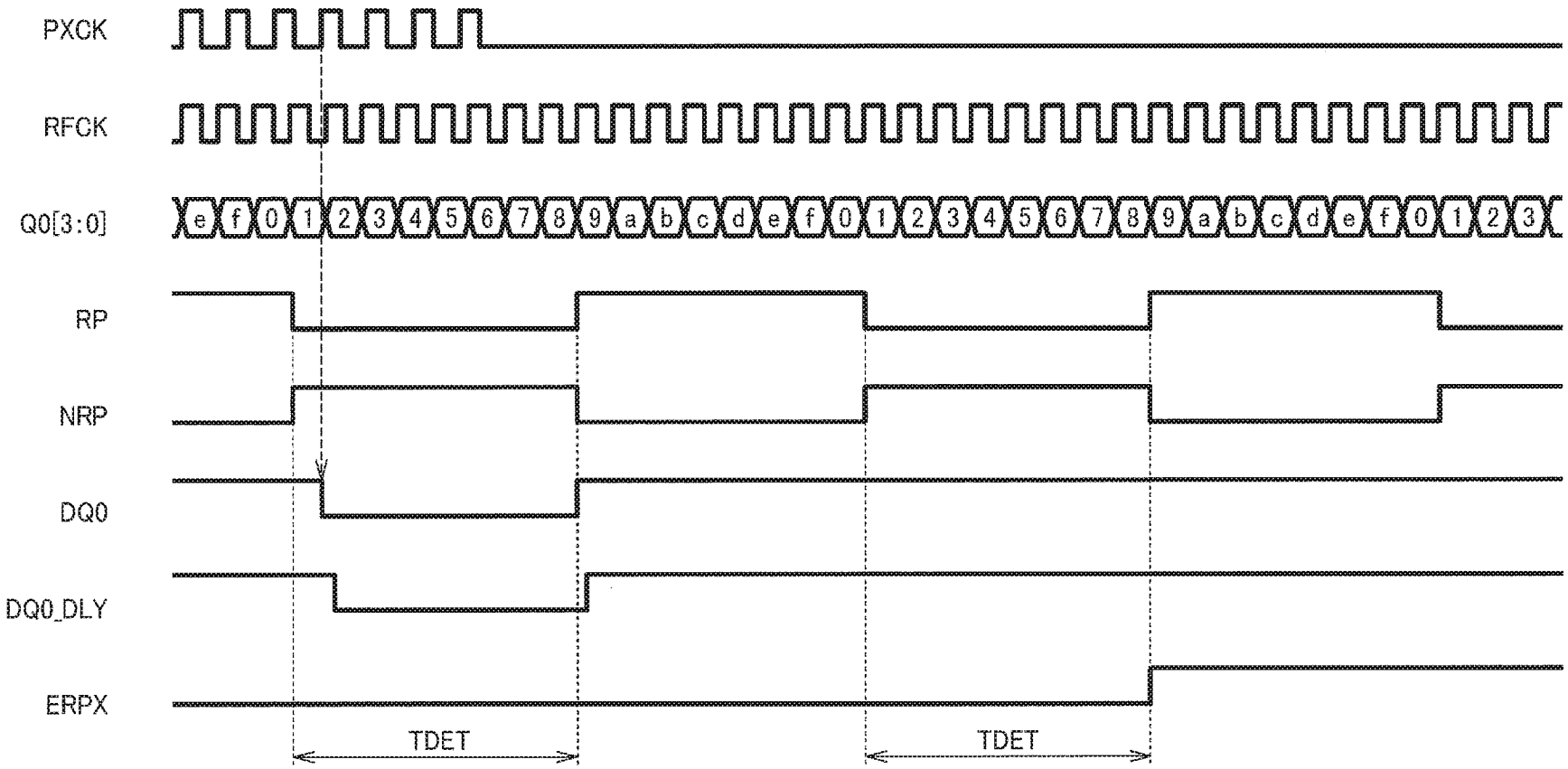
FIG. 4 is a diagram illustrating operations of the pixel clock judgment circuit.

FIG. 4 is a timing chart when the pixel clock signal PXCK is stopped. "Signal being stopped" indicates a state in which a pulse in the pixel clock signal PXCK disappears, and the logic level of the pixel clock signal PXCK does not change. In FIG. 4, an example in which the pixel clock signal PXCK is fixed at a low level is illustrated.

If no rising edge of the pixel clock signal PXCK has been input in the detection period TDET, the latch circuit FF2 does not latch a low level. Therefore, the signal DQ0 is kept at a high level in the detection period TDET. The signal DQ0_DLY, which is a delayed signal of the signal DQ0, is kept at a high level in the detection period TDET.

The latch circuit FF3 latches the signal DQ0_DLY at a rising edge of the detection period setting signal RP. Since the signal DQ0_DLY is at a high level, the level of the pixel clock judgment signal ERPX changes from a low level to a high level. In this way, if the pixel clock signal PXCK is anomalous, the level of the pixel clock judgment signal ERPX changes from a low level to a high level.

According to the embodiment described above, the edge detection circuit 111 includes the latch circuit FF2, and the latch circuit FF2, upon receiving an edge of the pixel clock signal PXCK in the detection period TDET, latches a low level. With this, an edge of the pixel clock signal PXCK can be detected. Also, the edge detection circuit 111 includes the latch circuit FF3 that latches the result of edge detection performed by the latch circuit FF2 based on the detection period setting signal RP. With this, the pixel clock judgment signal ERPX can be output based on the result of edge detection. In the present embodiment, the judgment as to whether or not the pixel clock judgment signal ERPX is normal is realized by the edge detection circuit 111 having a simple configuration in which only the two latch circuits FF2 and FF3, and the logical inversion circuit INV are included.

Also, in the present embodiment, the detection period TDET is set by the division ratio of the frequency-divider circuit BNC. That is, since the pixel clock signal PXCK is judged by detecting an edge, the detection period TDET is the only parameter that needs to be adjusted, and the setting is simplified. For example, it is possible that the reference clock signal RFCK and the pixel clock signal PXCK having various frequencies are input to the circuit device 100, and therefore it is desirable that the parameter can be changed in accordance with the frequencies. In the present embodiment, the detection period TDET need only be adjusted.

For example, as described above, a method is conceivable in which whether the pixel clock signal PXCK is normal or not is judged by judging whether or not the number of clocks of the pixel clock signal PXCK in the detection period has reached a predetermined value. However, with this method, there are two parameters, namely the detection period and the predetermined value, and therefore the two parameters need to be set so as to have an appropriate relationship. In this regard, since there is only one parameter in the present embodiment, the setting is simplified.

3. Signal Judgment Circuit

Figure 5:
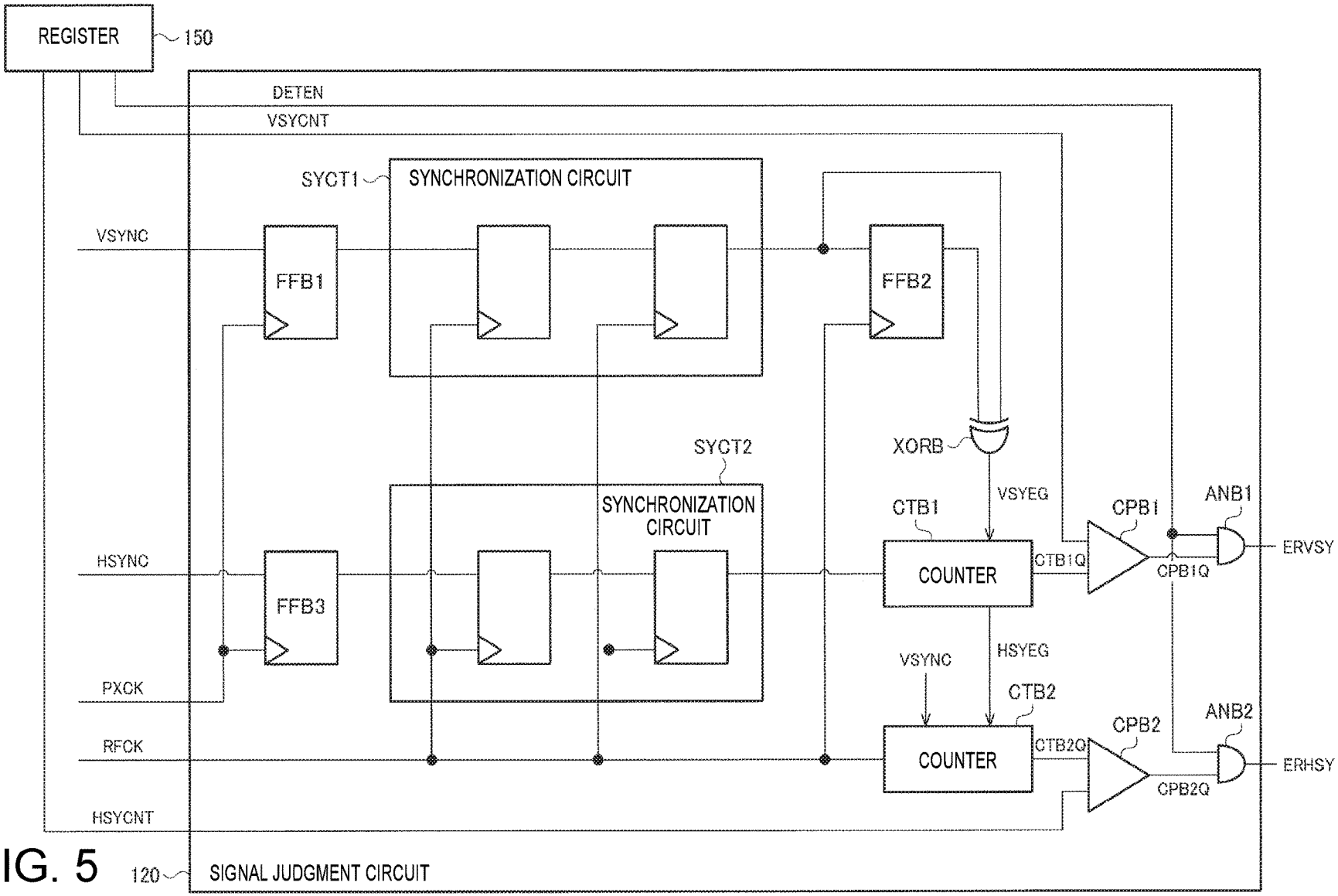
FIG. 5 is a detailed exemplary configuration of a signal judgment circuit.

FIG. 5 is a detailed exemplary configuration of the signal judgment circuit 120. In this exemplary configuration, a vertical synchronizing signal VSYNC and a horizontal synchronizing signal HSYNC correspond to the display control signal DCS in FIG. 1. Also, signals ERVSY and ERHSY correspond to the signal judgment signal EPDC in FIG. 1.

The signal judgment circuit 120 includes latch circuits FFB1 to FFB3, synchronization circuits SYCT1 and SYCT2, an exclusive OR circuit XORB, counters CTB1 and CTB2, comparison circuits CPB1 and CPB2, and AND circuits ANB1 and ANB2.

The latch circuit FFB1 latches the vertical synchronizing signal VSYNC based on the pixel clock signal PXCK. The synchronization circuit SYCT1 synchronizes the output signal of the latch circuit FFB1 with an edge timing of the reference clock signal RFCK. The latch circuit FFB2 latches the output signal of the synchronization circuit SYCT1 based on the reference clock signal RFCK. The exclusive OR circuit XORB outputs the exclusive OR of the output signal of the synchronization circuit SYCT1 and the output signal of the latch circuit FFB2 as a signal VSYEG. Pulse signals corresponding to rising edges and falling edges of the vertical synchronizing signal VSYNC are output as the signal VSYEG.

The latch circuit FFB3 latches the horizontal synchronizing signal HSYNC based on the pixel clock signal PXCK. The synchronization circuit SYCT2 synchronizes the output signal of the latch circuit FFB3 with an edge timing of the reference clock signal RFCK. The counter CTB1 outputs a count value CTB1Q by counting the number of pulses of the horizontal synchronizing signal HSYNC that has been synchronized by the synchronization circuit SYCT2. The count value CTB1Q is initialized by the pulse signal of the signal VSYEG.

The register 150 stores a threshold value VSYSCNT. For example, the threshold value VSYSCNT is written into the register 150 from the processing device 200 in FIG. 1 via the interface circuit 170. The comparison circuit CPB1 compares the count value CTB1Q with the threshold value VSYSCNT. Specifically, the number of pulses of the horizontal synchronizing signal HSYNC that are input in the vertical synchronization period is denoted as NPV, when the vertical synchronizing signal VSYNC is normal. Here, the threshold value is set as VSYSCNT≥NPV. If CTB1Q>VSYSCNT, the comparison circuit CPB1 judges that the vertical synchronizing signal VSYNC is anomalous. At this time, the comparison circuit CPB1 outputs a signal CPB1Q at a high level. If CTB1Q<VSYSCNT, the comparison circuit CPB1 judges that the vertical synchronizing signal VSYNC is normal. At this time, the comparison circuit CPB1 outputs the signal CPB1Q at a low level.

The AND circuit ANB1 outputs the logical product of the signal CPB1Q and an enable signal DETEN from the register 150 as a signal ERVSY. For example, the enable signal DETEN is written into the register 150 from the processing device 200 in FIG. 1 via the interface circuit 170. When the signal judgment function is enabled, DETEN is at a high level, and when the signal judgment function is disabled, DETEN is at a low level. When the signal judgment function is enabled, the signal CPB1Q is output as the signal ERVSY.

The counter CTB2 outputs a count value CTB2Q by counting the number of clocks of the reference clock signal RFCK. The count value CTB2Q is initialized when a pulse of a signal HSYEG is input to the counter CTB2. Also, the count value CTB2Q is initialized when a pulse of the vertical synchronizing signal VSYNC is input to the counter CTB2. The signal HSYEG is input to the counter CTB2 from the counter CTB1. For example, the counter CTB1 generates a pulse signal every time the count value CTB1Q is incremented, and outputs the pulse signal as the signal HSYEG.

The register 150 stores a threshold value HSYSCNT. For example, the threshold value HSYSCNT is written into the register 150 from the processing device 200 in FIG. 1 via the interface circuit 170. The comparison circuit CPB2 compares the count value CTB2Q with the threshold value HSYSCNT. Specifically, the number of pulses of the reference clock signal RFCK that are input in the horizontal synchronization period is denoted as NPH, when the horizontal synchronizing signal HSYNC is normal. Here, the threshold value is set as HSYSCNT≥NPH. If CTB2Q>HSYSCNT, the comparison circuit CPB2 judges that the horizontal synchronizing signal HSYNC is anomalous. At this time, the comparison circuit CPB2 outputs a signal CPB2Q at a high level. If CTB2Q<HSYSCNT, the comparison circuit CPB2 judges that the horizontal synchronizing signal HSYNC is normal. At this time, the comparison circuit CPB2 outputs the signal CPB2Q at a low level.

The AND circuit ANB2 outputs the logical product of the signal CPB2Q and the enable signal DETEN as the signal ERHSY. When the signal judgment function is enabled, the signal CPB2Q is output as the signal ERHSY.

According to the embodiment described above, the signal judgment circuit 120 judges whether or not the horizontal synchronizing signal HSYNC is normal by measuring the period between edges of the horizontal synchronizing signal HSYNC based on the reference clock signal RFCK. The period between edges of the horizontal synchronizing signal HSYNC corresponds to the period of the signal HSYEG. Also, the measurement result corresponds to the count value CTB2Q.

In this way, the signal judgment circuit 120 can judge whether or not the display control signal is normal based on the reference clock signal RFCK. That is, whether or not the period between edges of the display control signal is a predetermined threshold value or less can be judged by performing measurement using the reference clock signal RFCK. Note that, in FIG. 5, a case has been described, as an example, where the signal judgment circuit 120 measures the period between edges of the horizontal synchronizing signal HSYNC based on the reference clock signal RFCK, but the configuration of the signal judgment circuit 120 is not limited thereto. That is, the signal judgment circuit 120 may measure the period between edges of a display control signal other than the horizontal synchronizing signal HSYNC based on the reference clock signal RFCK. The display control signal other than the horizontal synchronizing signal HSYNC is a data enable signal, for example. The data enable signal is a signal indicating that the transfer of image data is enabled. That is, the processing device 200 enables the data enable signal in a period in which image data is transmitted to the interface circuit 170.

4. Mask Circuit

Figure 6:
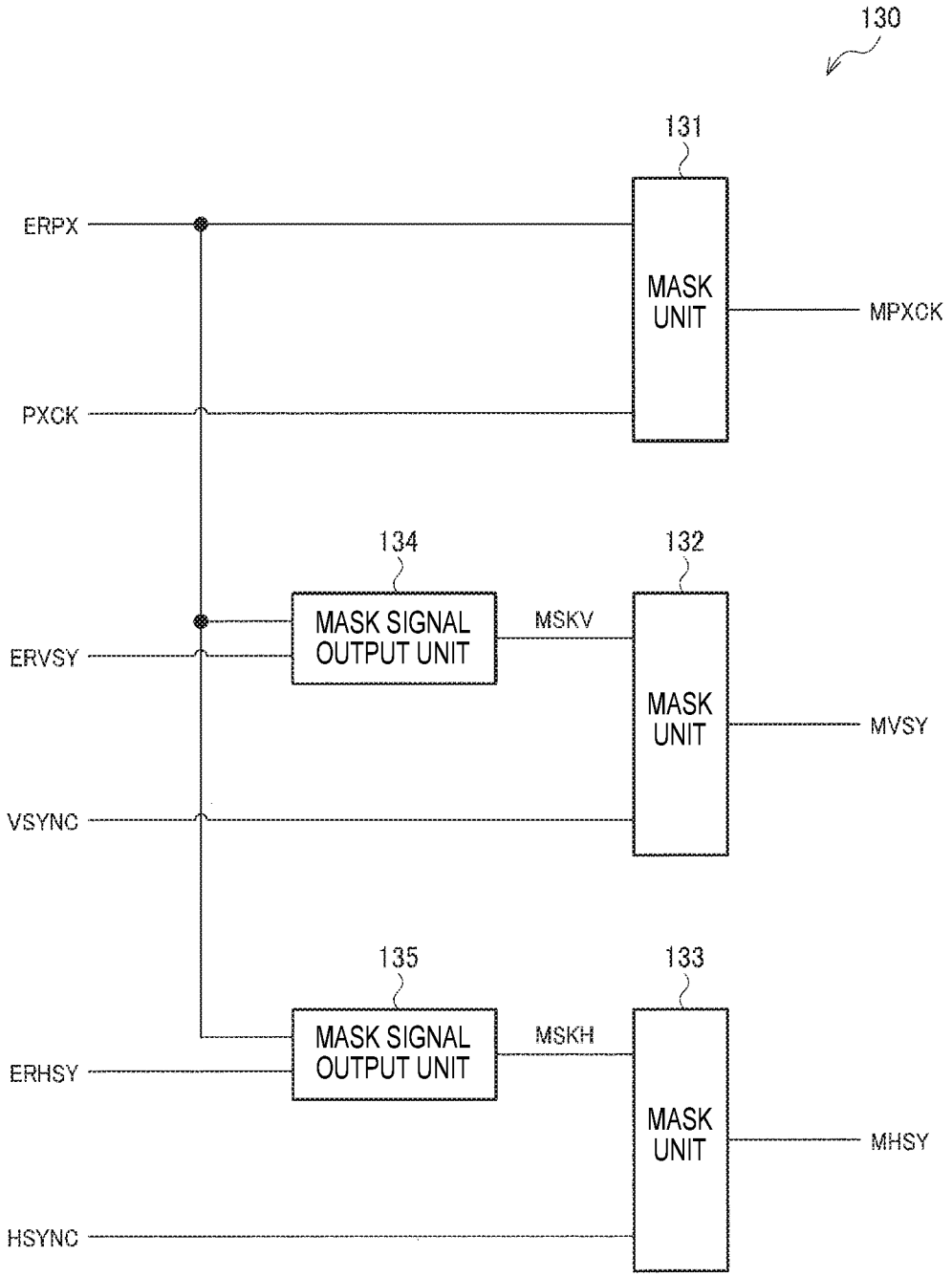
FIG. 6 is a detailed exemplary configuration of a mask circuit.

FIG. 6 is a detailed exemplary configuration of the mask circuit 130. The mask circuit 130 includes mask units 131 to 133, and mask signal output units 134 and 135.

If the pixel clock judgment signal ERPX is deactivated, the mask unit 131 does not mask the pixel clock signal PXCK. That is, the mask unit 131 outputs the pixel clock signal PXCK as the pixel clock signal MPXCK. On the other hand, if the pixel clock judgment signal ERPX is activated, the mask unit 131 masks the pixel clock signal PXCK. That is, the mask unit 131 fixes the pixel clock signal MPXCK at a low level or a high level.

The mask signal output unit 134 outputs a deactivated mask signal MSKV when both of the pixel clock judgment signal ERPX and the signal ERVSY are deactivated. The mask signal output unit 134 outputs an activated mask signal MSKV when at least one of the pixel clock judgment signal ERPX and the signal ERVSY is activated.

If the mask signal MSKV is deactivated, the mask unit 132 does not mask the vertical synchronizing signal VSYNC. That is, the mask unit 132 outputs the vertical synchronizing signal VSYNC as a vertical synchronizing signal MVSY. On the other hand, if the mask signal MSKV is activated, the mask unit 132 masks the vertical synchronizing signal MVSY. That is, the mask unit 132 fixes the vertical synchronizing signal MVSY at a low level or a high level.

The mask signal output unit 135 outputs a deactivated mask signal MSKH when both of the pixel clock judgment signal ERPX and the signal ERHSY are deactivated. The mask signal output unit 135 outputs an activated mask signal MSKH when at least one of the pixel clock judgment signal ERPX and the signal ERHSY is activated.

If the mask signal MSKH is deactivated, the mask unit 133 does not mask the horizontal synchronizing signal HSYNC. That is, the mask unit 133 outputs the horizontal synchronizing signal HSYNC as a horizontal synchronizing signal MHSY. On the other hand, if the mask signal MSKH is activated, the mask unit 133 masks the horizontal synchronizing signal HSYNC. That is, the mask unit 133 fixes the horizontal synchronizing signal MHSY at a low level or a high level.

The mask units 131 to 133 and the mask signal output units 134 and 135 are each a combinational circuit of logic elements. The logic elements include a logical inversion circuit, an OR circuit, an AND circuit, and the like.

In FIG. 6, the vertical synchronizing signal MVSY and the horizontal synchronizing signal MHSY correspond to the display control signal MDCS in FIG. 1. When neither the pixel clock signal MPXCK nor the display control signal MDCS is masked, the timing control circuit 140 outputs the display control signal DCSQ for the display driver based on the pixel clock signal MPXCK and the display control signal MDCS.

On the other hand, when at least one of the pixel clock signal MPXCK and the display control signal MDCS is masked, the timing control circuit 140 generates the display control signal DCSQ for the display driver based on the reference clock signal RFCK. When neither the pixel clock signal MPXCK nor the display control signal MDCS is masked, the timing control circuit 140 controls the transition timing of the display control signal DCSQ for the display driver based on the pixel clock signal MPXCK. On the other hand, when at least one of the pixel clock signal MPXCK and the display control signal MDCS is masked, the timing control circuit 140 controls the transition timing of the display control signal DCSQ for the display driver based on the reference clock signal RFCK.

In this way, even if one or more of the pixel clock signal MPXCK and the display control signal MDCS are anomalous, the display control signal DCSQ for the display driver can be supplied to the display driver 300. It is possible that, if the display control signal supplied to the display driver 300 is anomalous, an electro-optical panel driven by the display driver 300 fails. However, according to the present embodiment, even if the display control signal from the processing device 200 is anomalous, the display control signal can be continued to be supplied to the display driver 300.

Figure 7:
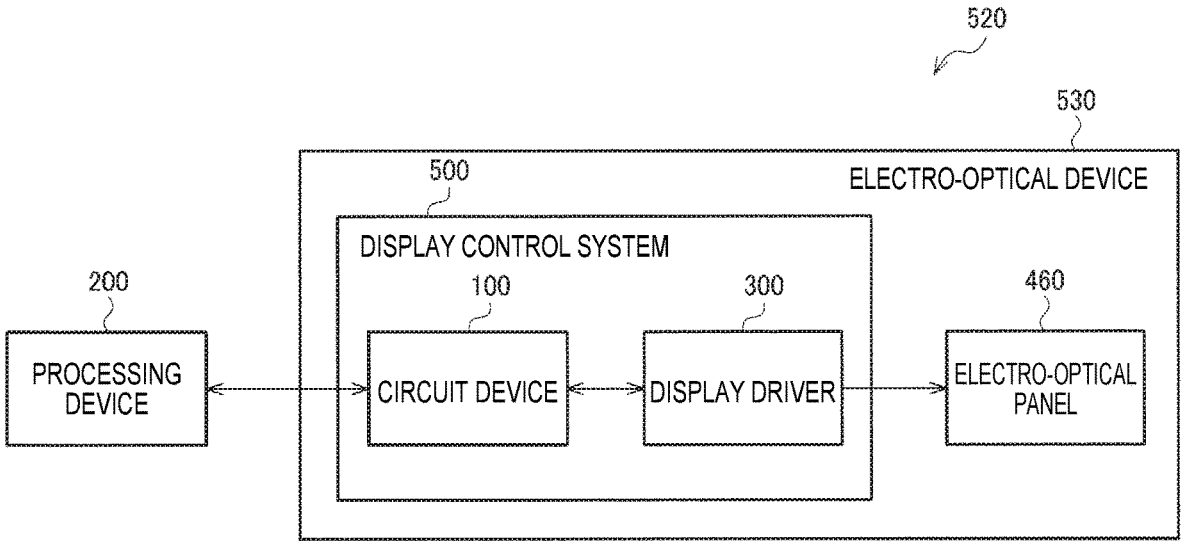
FIG. 7 is an exemplary configuration of a display system.

5. Display System, Electro-Optical Device, Electronic Apparatus, and Mobile Body FIG. 7 is an exemplary configuration of a display system 520 including the circuit device 100. The display system 520 includes the processing device 200 and an electro-optical device 530. The electro-optical device 530 includes a display control system 500 and an electro-optical panel 460. The display control system 500 includes the circuit device 100 and the display driver 300.

An in-vehicle display system can be envisioned as the display system 520. The electro-optical panel 460 is a cluster panel provided in front of a driver's seat, for example. Note that an apparatus to which the display system 520 is to be applied is not limited thereto, and the display system 520 can be applied to various electronic apparatuses such as a projector, a television device, an information processing device, and a mobile information terminal.

The processing device 200 transmits image data to the circuit device 100. The circuit device 100 receives image data from the processing device 200, and performs suitable processing on the image data. The circuit device 100 outputs the image data subjected to the processing and a timing control signal to the display driver 300. The timing control signal includes a horizontal synchronizing signal, a vertical synchronizing signal, a pixel clock signal, and the like. The display driver 300 receives the image data and the timing control signal from the circuit device 100, and drives the electro-optical panel 460 based on the image data and the timing control signal. With this, an image corresponding to the image data is displayed in the electro-optical panel 460.

The processing device 200 is a processor such as a CPU (Central Processing Unit) or a microcomputer. Alternatively, the processing device 200 may be constituted by a plurality of circuit components mounted on a circuit board. The circuit device 100 is an integrated circuit device. The display driver 300 is an integrated circuit device, and is mounted on a glass substrate of the electro-optical panel 460, for example. Alternatively, the configuration may be such that the display driver 300 is mounted on a circuit board, and the circuit board and the electro-optical panel 460 are connected. The electro-optical panel 460 is a matrix-type liquid-crystal display panel or an EL (Electro Luminescence) panel, for example.

Figure 8:
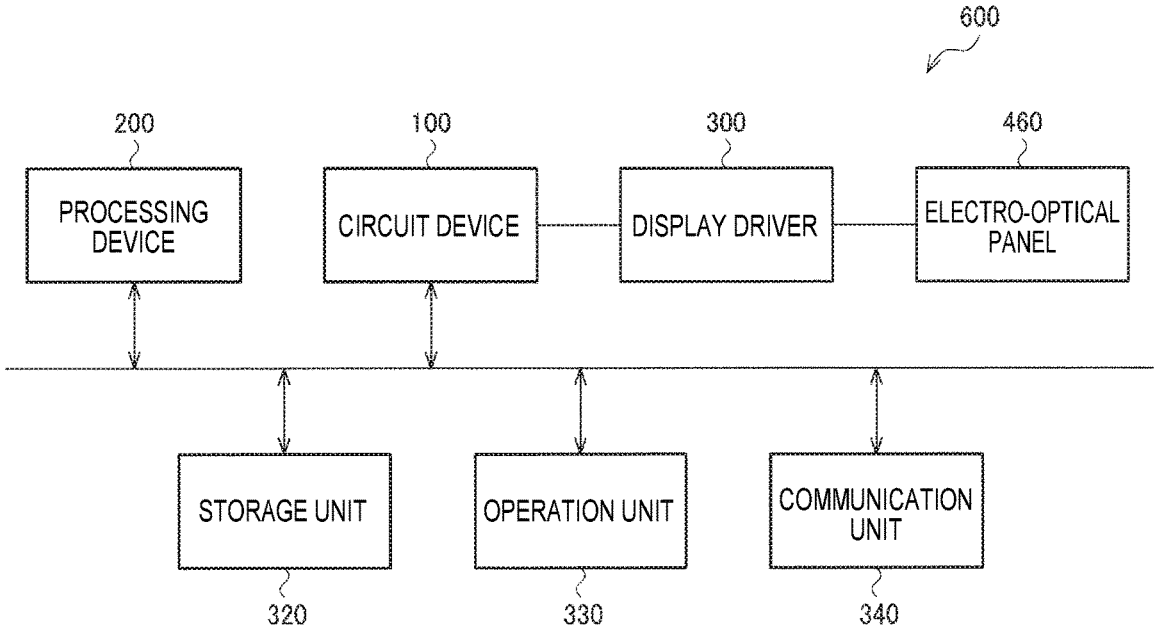
FIG. 8 is an exemplary configuration of an electronic apparatus.

FIG. 8 is an exemplary configuration of an electronic apparatus including the circuit device 100. Various electronic apparatuses incorporating a display device can be envisioned as the electronic apparatus of the present embodiment. For example, an in-vehicle display device, a display, a projector, a television device, an information processing device, a mobile information terminal, a car navigation system, a mobile game terminal, and a DLP (Digital Light Processing) device can be envisioned as the electronic apparatus of the present embodiment. The in-vehicle display device is a meter panel or the like.

The electronic apparatus 600 includes a processing device 200, a circuit device 100, a display driver 300, an electro-optical panel 460, a storage unit 320, an operation unit 330, and a communication unit 340. Note that the storage unit 320 is a storage device or a memory. The operation unit 330 is an operation device. The communication unit 340 is a communication device.

The operation unit 330 is a user interface for receiving various operations made by a user. For example, the operation unit 330 is constituted by a button, a mouse, a keyboard, and a touch panel attached to the electro-optical panel 460. The communication unit 340 is a data interface for communicating image data and control data. For example, the communication unit 340 is a wired communication interface such as a USB or a wireless communication interface such as a wireless LAN. The storage unit 320 stores image data input from the communication unit 340. Alternatively, the storage unit 320 functions as a working memory of the processing device 200. The processing device 200 performs processing to control the units of the electronic apparatus, and various types of data processing. The circuit device 100 is a display controller. That is, the circuit device 100 performs processing to control the display driver 300. For example, the circuit device 100 converts the format of image data transferred from the communication unit 340 or the storage unit 320 via the processing device 200 to a format that can be accepted by the display driver 300, and outputs the converted image data to the display driver 300. The display driver 300 drives the electro-optical panel 460 based on the image data that has been transferred from the circuit device 100.

Figure 9:
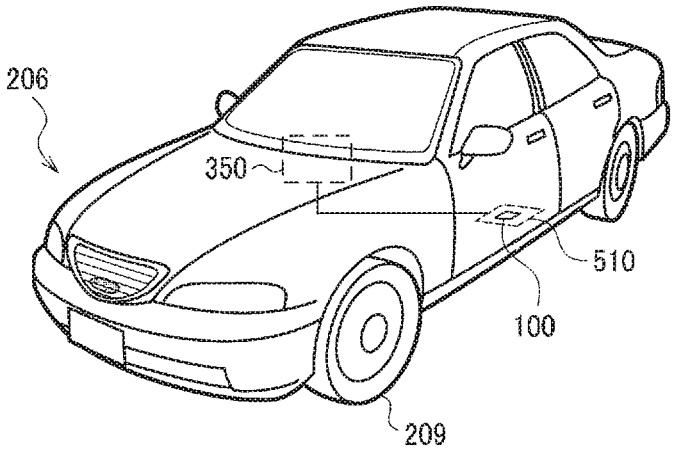
FIG. 9 is an example of a mobile body.

FIG. 9 is an exemplary configuration of a mobile body including the circuit device 100. The mobile body is an apparatus or device that includes a drive mechanism such as an engine or a motor, steering mechanisms such as a steering wheel or a rudder, and various electronic apparatus, for example, and moves on the ground, in the air, and on the sea. Various types of mobile bodies such as a car, an airplane, a motorcycle, a ship, a mobile robot, and a walking robot can be envisioned as the mobile body of the present embodiment, for example. FIG. 9 schematically illustrates an automobile 206 serving as a specific example of the mobile body. The display device 350 and a control device 510 that controls the units of the automobile 206 are incorporated into the automobile 206. The circuit device 100 of the present embodiment is mounted on a circuit board of the control device 510, for example. Alternatively, the circuit device 100 of the present embodiment may be included in the display device 350. The control device 510 creates an image that shows pieces of information such as speed, remaining fuel amount, travel distance, and settings of various types of devices to a user, and transmits the image to the display device 350 such that the image is displayed in the electro-optical panel.

The circuit device described in the embodiment described above includes a pixel clock judgment circuit, a signal judgment circuit, and a mask circuit. The pixel clock judgment circuit includes an edge detection circuit that detects an edge of a pixel clock signal. The pixel clock judgment circuit outputs a pixel clock judgment signal. If no edge of the pixel clock signal has been detected by the edge detection circuit in a detection period set by a reference clock signal, the pixel clock judgment signal is activated. The signal judgment circuit judges whether or not the display control signal of the electro-optical panel is normal based on the reference clock signal. The signal judgment circuit outputs a signal judgment signal that is activated if the display control signal is anomalous. The mask circuit masks the display control signal when at least one of the pixel clock judgment signal and the signal judgment signal is activated.

According to the present embodiment, whether or not the display control signal is normal is judged, and also whether or not the pixel clock signal is normal is judged. With this, the reliability in anomaly judgment is improved compared with a case where only the judgment as to whether or not the display control signal is normal is performed. Also, whether the pixel clock signal is normal or not is judged by detecting an edge, and therefore the increase in circuit scale and circuit becoming complex can be suppressed.

Also, in the present embodiment, the pixel clock judgment circuit includes a detection period setting circuit. The detection period setting circuit may set the detection period based on the reference clock signal.

In this way, as a result of the detection period setting circuit setting the detection period, the detection period during which the edge detection circuit detects an edge of the pixel clock signal is set. Also, the pixel clock judgment circuit can judge whether or not the pixel clock signal is normal by judging whether or not an edge of the pixel clock signal has been detected by the edge detection circuit in the detection period set by the detection period setting circuit.

Also, in the present embodiment, the detection period setting circuit may set the detection period based on setting information for setting the length of the detection period and the reference clock signal.

In this way, the detection period setting circuit can set the length of the detection period based on the setting information. That is, the length of the detection period can be adjusted by changing the setting information.

Also, in the present embodiment, the detection period setting circuit may include a frequency-divider circuit that outputs a frequency-division clock signal by frequency-dividing the reference clock signal. The setting information may be information regarding the division ratio of the frequency-divider circuit.

In this way, the length of the detection period is set by setting the division ratio information of the frequency-divider circuit. Since the frequency-divider circuit frequency-divides the reference clock signal, the detection period is set based on the setting information and the reference clock signal.

Also, in the present embodiment, the detection period setting circuit may include a first latch circuit. The first latch circuit may output a detection period setting signal by latching the frequency-division clock signal based on the reference clock signal. The edge detection circuit may include a second latch circuit and a third latch circuit. The second latch circuit is in a reset state in a period in which the detection period setting signal is deactivated, and latches a deactivated signal when an edge of the pixel clock signal is input in the detection period in which the detection period setting signal is activated. The third latch circuit outputs a pixel clock judgment signal by latching the result of edge detection by the second latch circuit, based on the detection period setting signal.

In this way, the second latch circuit can detect an edge of the pixel clock signal in the detection period in which the detection period setting signal is activated. That is, the second latch circuit latches a deactivated signal when an edge of the pixel clock signal is input to the second latch circuit in the detection period, and as a result, the result of edge detection indicates a deactivated state. On the other hand, if no edge of the pixel clock signal has been input to the second latch circuit in the detection period, the second latch circuit does not latch a deactivated signal, and therefore the result of edge detection indicates an activated state.

Also, in the present embodiment, the circuit device may include a timing control circuit. The timing control circuit may generate a display control signal for the display driver that is used by the display driver that drives an electro-optical panel based on the display control signal that is input via the mask circuit.

In this way, when the display control signal is not masked by the mask circuit, the timing control circuit can generate the display control signal for the display driver based on the display control signal that is not masked. On the other hand, when the display control signal is masked by the mask circuit, generation of the display control signal for the display driver based on the display control signal is stopped.

Also, in the present embodiment, when the display control signal is masked by the mask circuit, the timing control circuit may generate the display control signal for the display driver based on the reference clock signal.

In this way, even if it has been judged that the display control signal is anomalous, the display control signal for the display driver can be generated based on the reference clock signal. Also, the display control signal for the display driver can be supplied to a display driver.

Also, in the present embodiment, the signal judgment circuit may judge whether or not the display control signal is normal by measuring the period between edges of the display control signal based on the reference clock signal.

In this way, the signal judgment circuit can judge whether or not the display control signal is normal based on the reference clock signal. That is, whether or not the period between edges of the display control signal is a predetermined threshold value or less can be judged by measuring the period using the reference clock signal.

Also, in the present embodiment, the display control signal may include at least one of a horizontal synchronizing signal, a vertical synchronizing signal, and a data enable signal.

In this way, the signal judgment circuit can judge whether or not at least one of the horizontal synchronizing signal, the vertical synchronizing signal, and the data enable signal is normal.

Also, in the present embodiment, an electro-optical device includes the circuit device described above and an electro-optical panel.

Also, in the present embodiment, an electronic apparatus includes the circuit device described above.

Also, in the present embodiment, a mobile body includes the circuit device described above.

Note that although an embodiment has been described in detail above, a person skilled in the art will readily appreciate that it is possible to implement numerous variations and modifications that do not depart substantially from the novel aspects and effect of the invention. Accordingly, all such variations and modifications are also to be included within the scope of the invention. For example, terms that are used within the description or drawings at least once together with broader terms or alternative synonymous terms can be replaced by those other terms at other locations as well within the description or drawings. Also, all combinations of the embodiment and variations are also encompassed in the range of the invention. Moreover, the configuration and operation of the circuit device, the electro-optical device, the electronic apparatus, and the mobile body are not limited to those described in the present embodiment, and various modifications are possible.

What is claimed is:

1. A circuit device comprising:

a pixel clock judgment circuit that includes an edge detection circuit that is configured to detect an edge of a pixel clock signal, and is configured to determine whether the edge of the pixel clock signal has been detected by the edge detection circuit in a detection period that is set by a reference clock signal and to output a pixel clock judgment signal that is activated when it is determined that the edge of the pixel clock signal has not been detected by the edge detection circuit in the detection period;

a signal judgment circuit that is configured to judge whether or not a display control signal of an electro-optical panel is normal based on the reference clock signal, and output a signal judgment signal that is activated when it is judged that the display control signal is anomalous; and a mask circuit configured to separately receive both the pixel clock judgment signal and the signal judgment signal, to determine whether the pixel clock judgment signal is activated, to determine whether the signal judgment signal is activated, and to mask the display control signal when it is determined that at least one of the pixel clock judgment signal and the signal judgment signal is activated.

2. The circuit device according to claim 1, wherein the pixel clock judgment circuit includes a detection period setting circuit configured to set the detection period based on the reference clock signal.

3. The circuit device according to claim 2, wherein the detection period setting circuit is configured to set the detection period based on setting information for setting the length of the detection period and the reference clock signal.

4. The circuit device according to claim 3, wherein the detection period setting circuit includes a frequency-divider circuit that is configured to output a frequency-division clock signal by frequency-dividing the reference clock signal, and the setting information is information regarding a division ratio of the frequency-divider circuit.

5. The circuit device according to claim 4, wherein the detection period setting circuit includes a first latch circuit that is configured to output a detection period setting signal by latching the frequency-division clock signal based on the reference clock signal, and the edge detection circuit includes:

a second latch circuit that is in a reset state in a period in which the detection period setting signal is deactivated, and latches a deactivated signal when the edge of the pixel clock signal is input in the detection period in which the detection period setting signal is activated, and a third latch circuit that is configured to output the pixel clock judgment signal by latching the result of edge detection by the second latch circuit, based on the detection period setting signal.

6. The circuit device according to claim 1, further comprising a timing control circuit configured to generate a display control signal for a display driver that is used for a display driver that drives the electro-optical panel based on the display control signal that is input via the mask circuit.

7. The circuit device according to claim 6, wherein the timing control circuit is configured to generate, when the display control signal is masked by the mask circuit, the display control signal for the display driver based on the reference clock signal.

8. The circuit device according to claim 1, wherein the signal judgment circuit is configured to judge whether or not the display control signal is normal by measuring a period between edges of the display control signal based on the reference clock signal.

9. The circuit device according to claim 1, wherein the display control signal includes at least one of a horizontal synchronizing signal, a vertical synchronizing signal, and a data enable signal.

10. An electro-optical device comprising:

the circuit device according to claim 1; and the electro-optical panel.

11. An electronic apparatus comprising the circuit device according to claim 1.

12. A mobile body comprising a circuit device according to claim 1.

* * * * *